United States Patent [19]

Albers et al.

[11] Patent Number: 4,583,496

[45] Date of Patent: Apr. 22, 1986

[54] SOOT BLOWER

[75] Inventors: Karl Albers, Anholt; Hans Schwade, Voerde, both of Fed. Rep. of Germany

[73] Assignee: Bergemann GmbH, Wesel, Fed. Rep. of Germany

[21] Appl. No.: 725,235

[22] Filed: Apr. 19, 1985

[51] Int. Cl.[4] ..... F22B 37/52

[52] U.S. Cl. ..... 122/379; 122/390; 122/392

[58] Field of Search ..... 110/234; 122/379, 384, 122/381, 390, 391, 405

[56] References Cited

U.S. PATENT DOCUMENTS

| | | | |
|---|---|---|---|
| 2,858,808 | 11/1958 | Rowand | 122/379 |
| 3,344,459 | 10/1967 | Jankowski | 122/392 |
| 3,875,904 | 4/1975 | Astrom | 122/379 |
| 4,333,742 | 6/1982 | Tanca | 122/390 |
| 4,422,882 | 12/1983 | Nelson et al. | 122/390 |
| 4,452,183 | 6/1984 | Yazidjian | 122/390 |
| 4,479,459 | 10/1984 | Piper | 122/379 |
| 4,492,187 | 1/1985 | Hammond | 122/390 |
| 4,498,427 | 2/1985 | Todd | 122/379 |

*Primary Examiner*—Henry C. Yuen

*Attorney, Agent, or Firm*—Max Fogiel

[57] ABSTRACT

A soot blower for cleaning heating surfaces of a heat exchanger wherein a lance has jets at its front and is connected at its rear through a soot blower valve to a feed line for a blowing medium. The lance passes through a wall of the heat exchanger and is sealed by a wall casing where the lance passes into the heat exchanger. A connector is provided for a purging medium for the lance between the soot blower valve and the jets of the lance. There is also a connector for a sealing medium on the wall casing. A compressor generates and distributes purging medium and sealing medium for the soot blower connected to the respective connectors. A check valve between the soot blower valve and the purging medium connector prevents flow of blowing medium into the generating and distributing compressor.

10 Claims, 3 Drawing Figures

SOOT BLOWER

BACKGROUND OF THE INVENTION

The present invention relates to a soot blower for cleaning the surfaces of a heat exchanger.

In such soot blowers, when not actuated, the corrosive hot gases carrying soot from the combustion of solid, liquid or gaseous fuels come into contact with the soot blower lance, and through the blower jet openings in the lance can enter the lance tube, where they cause damage by corrosion or fouling.

To reduce this problem, an inert gaseous purging medium, for example, air, is introduced beyond the soot blower valve when the blower is inoperative, with the pressure of the purging medium being greater than that of the combustion gases in the heat exchanger. A stream of the inert purging medium thus passes through the lance into the heat exchanger, and prevents the entry of the corrosive gases at the jets. A sealing medium, for example, air, is also blown into the wall casing surrounding the entry point of the lance into the heat exchanger to provide a seal against escape of combustion gas to the environment.

In heat exchangers, particularly those for power station boilers, which are provided with several soot blowers, both the purging air and the sealing air are drawn from a central blower system and distributed to the individual soot blowers. This requires an expensive ducting system. The relatively low pressure level of the central blower frequently makes it necessary to use large-diameter ducts to reduce frictional losses. A special control element is needed ahead of each soot blower to achieve even distribution of the required amounts of air, a difficulty which is compounded by the different frictional losses resulting from the unequal duct lengths to the individual soot blowers. Finally, the connections at the soot blower valve and/or at the wall casing must be flexible to allow for movement of the soot blower and the effects of expansion.

A further disadvantage of such central air systems, is that very often the purging and sealing air is drawn from a blower which is normally shut down when the heat exchanger is switched off so that the purging and sealing is then no longer present. This means that the stove effect which persists within the hot heat exchanger drives the undesirable combustion gases into the soot blower lance or from the wall opening of the heat exchanger into the environment.

It is a further requirement of many manufacturers and operators of heat exchangers that the quantity of air introduced at each soot blower should be as low as possible and should not exceed a quite low maximum value even in the event of those pressure variations which typically frequently occur on the combustion gas side.

SUMMARY OF THE INVENTION

Accordingly it is an object of the present invention to simplify the known system for supplying a soot blower with purging and sealing media.

The object of the present invention is achieved by apparatus with which it is possible to dispense with the central blower and the expensive air-distribution system. The purging and sealing media are generated by a compressor provided on each separate soot blower. The compressor and the distribution system are arranged so that each soot blower continuously receives the required quantity of purging and sealing air. The required coarse adjustments can be undertaken by the manufacturer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
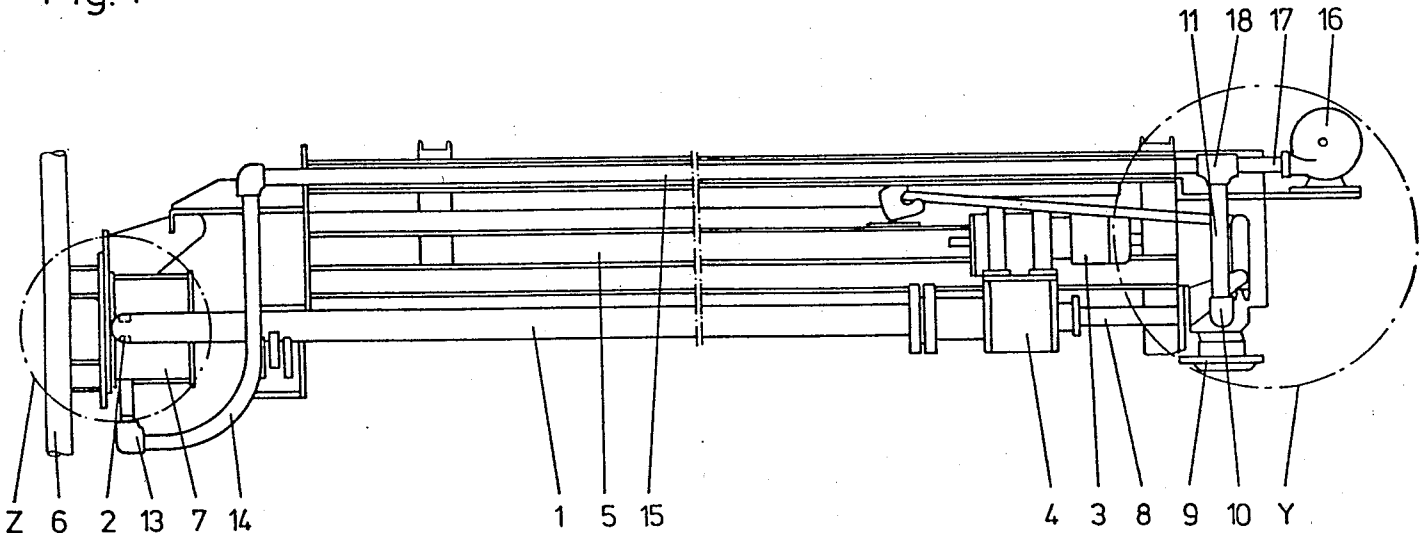
FIG. 1 is a side view of a novel soot blower assembly, according to the present invention.

In the drawings, a long tube helical soot blower is shown and with which the invention is described by way of example only. The inventive subject matter also finds use in other types of soot blowers.

The soot blower illustrated comprises a lance 1, having jets 2 at its front end. The lance 1 is connected to a drive carriage 4 driven by motor 3, which together with the lance 1, can be moved on a fixed carrier rail 5. The motor 3 also rotates the lance 1 axially so that the jets 2 move along a helical path. The end points of the path for the lance 1 are determined by fixed limit switches.

The lance 1 can be moved into a heat exchanger through an entry port. The walls of such heat exchanger are defined by a wall tube 6. The entry port is surrounded by a wall casing 7 so as to seal it off from the outside atmosphere. When in the withdrawn position, the lance 1 is located with its jets 2 within the wall casing 7.

The sliding lance 1 surrounds a fixed inner tube 8, the rear end of which has a connector for a blowing medium, for example, steam. The quantity of blowing medium is controlled by a soot blower valve 9 arranged on the soot blower.

The inner tube 8 has also a connector 10 for a purging medium, for example, air. The purge air connector 10 is arranged above the valve seat of the soot blower valve 9, i.e., in the direction of flow of the blowing medium beyond the soot blower valve 9. The lance 1 is supplied with purging air through the purge air connector 10 and the inner tube 8, and when the apparatus is not in soot blowing mode this purging air exits through the jets 2. A check valve 12 (FIG. 2) is arranged in one of the purge air lines 11 leading to the purge air connector 10, and is so adjusted that the blowing medium cannot pass into the purge air line 11 when the soot blower valve 9 is open.

The wall casing 7 is provided with a connector 13 for a sealing medium, for example, air. The sealing air connector 13 is connected through a flexible line 14 with a sealing air line 15 arranged on the soot blower. The pressure of the purging air and of the sealing air is greater than pressure of the gas within the heat exchanger.

The purging air and the sealing air are both generated by a system devoted for the soot blower which comprises, a compressor 16, united with the soot blower as a unit. Electrical connector cable for the drive for the compressor 16 and for the motor 3 of the soot blower drive system runs from a central connector box.

Figure 2:
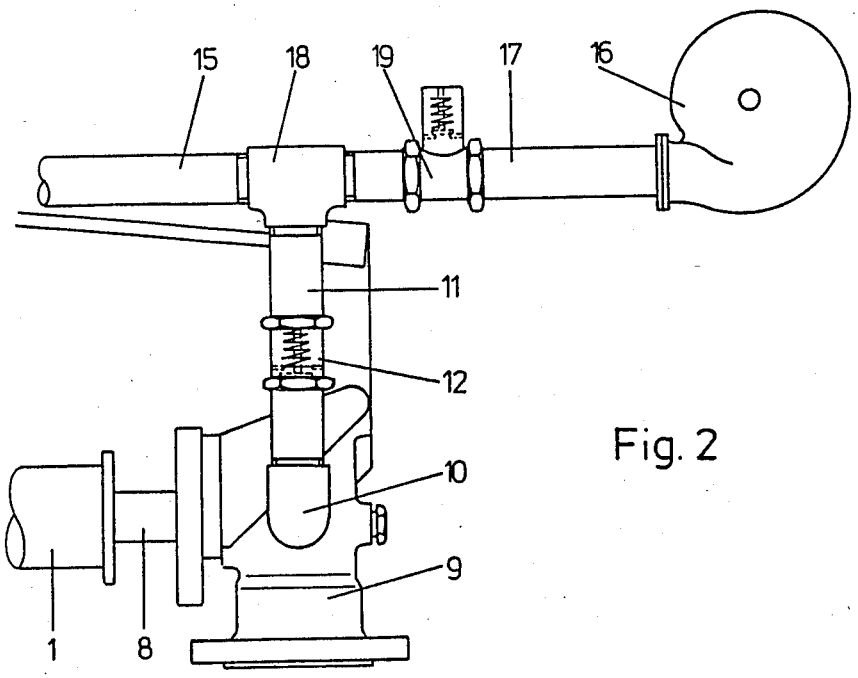
FIG. 2 is a detailed view of portion Y of FIG. 1.

As can be seen in FIGS. 1 and 2, the compressor 16 is arranged adjacent the soot blower valve 9. An air line 17 is connected to the output of the compressor 16 and passes to a T coupling 18. The sealing air line 15 branches off from the T coupling 18 to the sealing air connector 13 on the wall casing 7. The purge air line 11 is taken from T coupling 18 to the purge air connector 10. A safety valve 19 (FIG. 2) is incorporated in the air line 17, the flow-off pressure of which corresponds to the rated pressure of the compressor 16. The design of the compressor 16 is preferably such that its delivery volume is substantially independent of the back pressure on the combustion gas. Compressors which operate on the positive displacement principle may be used, such as piston or rotary piston compressors. The use of a by-pass compressor is, however, particularly advantageous. This is capable of operation unaffected by back pressure in the pressure range of 0.99–1.02 bar, which is that of interest in soot blower applications. The costs of such by-pass blowers are considerably less than those of the previously named compressor types. By using such a compressor configuration, it is possible to ensure that the delivery volumes rise at worst only slightly if the back pressure on the combustion is lower than the design point of the compressor 16. This is a considerable advantage over the radial blowers used for known central air systems. Such blowers have operating points which are closely dependent on the back pressure existing at the particular time.

A further advantage of the named compressors over conventional radial blowers is that they can operate against relatively high back pressure, so that larger frictional resistances within the soot blower can be overcome. This allows the use of the air introduced into the soot blower to be used both as purging air and as sealing air, in a soot blower of the long tube helical type illustrated. In such soot blower the jets 2 at the ends of the lance 1 are within the wall casing 7 when not in operation. The air which flows from the jets 2 on the one hand, prevents combustion gases entering the soot blower, and on the other, seals the heat exchanger wall. It is thus possible to dispense with the sealing air connector 13 on the wall casing 7. This solution is particularly advantageous, because the flexible line 14 necessitated by the movement of the heat exchanger wall can be eliminated. However, this version can only be used if the back pressure on the combustion gas is low, so that one can accept the fact that no sealing air is delivered while the soot blower is in the blowing mode. During blowing, the check valve 12 is closed and the compressor 16 is shut down or vents through the safety valve 19. However, for higher back pressures, as is illustrated, separated purge air connectors 10 and sealing air connectors 13 are provided.

Figure 3:
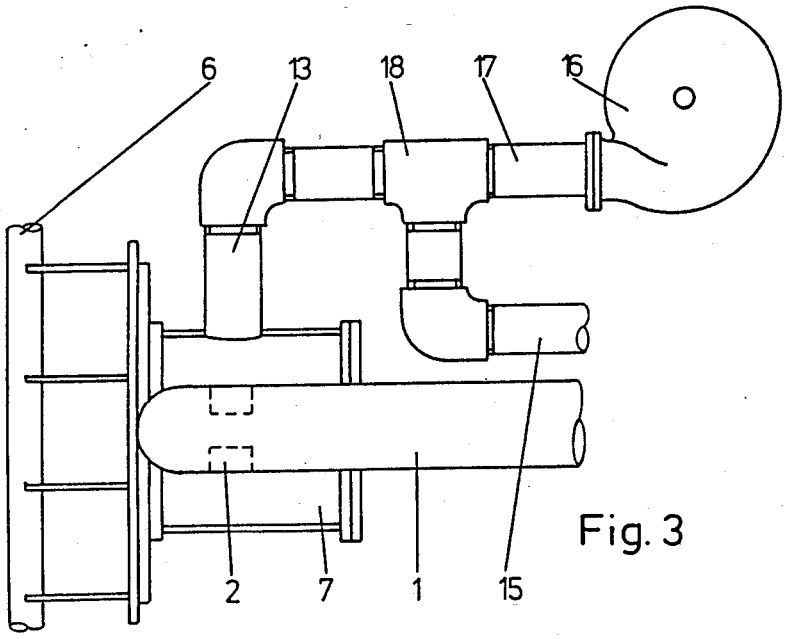
FIG. 3 is a detailed view of portion Z of FIG. 1.

In the embodiment shown in FIG. 3, the compressor 16 is arranged directly on the wall casing 7. Thus, the sealing air connector 13 is connected rigidly to the wall casing 7. The air blown into the wall casing 7 can serve simultaneously as purging air and sealing air and also to ensure that the combustion gases cannot escape directly to the environment or enter the soot blower.

If separate supplies of purging air and sealing air are to be provided, then, as is shown in FIG. 3, the T-coupling 18 in the air line 17 is provided with a branch to the purge air line 15. A separate purging air and sealing air supply is also necessary in those types of soot blower in which the jets 2 remain in the heat exchanger when the soot blower is not in operation, i.e., when the soot blower valve 9 is closed. In those types of multi-jet soot blower which remain constantly in the gas flow, a supply of purging air and sealing air can be selected as in each of the versions shown in FIGS. 2 and 3.

The control for the compressor 16 can be such that the compressor runs continuously, even during soot blower operation with the soot blower valve 19 open and the check valve 12 closed. Any overpressure is relieved by the safety valve 19. In soot blowers acted upon only by purging air, the control is such, however, that the compressor 16 is shutdown in the soot blower drive mode. Thus the switching for the compressor 16 is effected in accordance with operation of the travel limit switches for the soot blower.

Without further analysis, the foregoing will so fully reveal the gist of the present invention that others can, by applying current knowledge, readily adapty it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A soot blower for cleaning heating surfaces of a heat exchanger comprising: a lance having at its front end jets, said lance having a rear end connected through a soot blower valve to a feed line for a blowing medium, said lance passing through a wall of the heat exchanger and being sealed by a wall casing where the lance passes into the heat exchanger; a first connector for a purging medium for said lance between the soot blower valve and the jets of said lance; a second connector for a sealing medium on said wall casing; a system for generating and distributing purging medium and sealing medium for said soot blower connected to said respective connectors; and check valve means between the soot blower and said purging medium connector for preventing flow of blowing medium into said generating and distributing system, each soot blower having a separate blower for generating and distributing purging medium and sealing medium.

2. A soot blower as defined in claim 1, wherein said system comprises a compressor.

3. A soot blower as defined in claim 2, wherein said compressor comprises further a by-pass compressor.

4. A soot blower as defined in claim 2, including a safety valve between the compressor and the connectors for the purging medium and the sealing medium respectively, said safety valve being adjusted to release at the rated pressure of the compressor.

5. A soot blower as defined in claim 2, wherein said compressor is mounted onto the soot blower and forms a self-contained unit therewith.

6. A soot blower as defined in claim 5, wherein said compressor is arranged adjacent the soot blower valve.

7. A soot blower as defined in claim 6, wherein introduction of the purging medium occurs exclusively beyond the soot blower valve.

8. A soot blower as defined in claim 5, wherein said compressor is arranged adjacent the wall casing.

9. A soot blower as defined in claim 8, wherein the sealing and the purging medium are introduced at the wall casing.

10. A soot blower for cleaning heating surfaces of a heat exchanger comprising: a lance having at its front end jets, said lance having a rear end connected through a soot blower valve to a feed line for a blowing medium, said lance passing through a wall of the heat exchanger and being sealed by a wall casing where the lance passes into the heat exchanger; a first connector for a purging medium for said lance between the soot blower valve and the jets of said lance; a second connector for a sealing medium on said wall casing; a system for generating and distributing purging medium and sealing medium for said soot blower connected to said respective connectors; and check valve means between the soot blower and said purging medium connector for preventing flow of blowing medium into said generating and distributing system, each soot blower having a separate blower for generating and distributing purging medium and sealing medium; said system comprising a compressor; a safety valve between said compressor and the connectors for the purging medium and the sealing medium respectively, said safety valve being adjusted to release at the rated pressure of the compressor; said compressor being mounted onto the soot blower and forming a self-contained unit therewith; said compressor being arranged adjacent the soot blower valve; purging medium occurring exclusively beyond said soot blower valve; said compressor being arranged adjacent the wall casing; said sealing and purging medium being introduced at the wall casing.

* * * * *